US008054307B2

(12) United States Patent
Jang

(10) Patent No.: US 8,054,307 B2
(45) **Date of Patent: *Nov. 8, 2011**

(54) DEVICE AND METHOD OF DRIVING LIGHT SOURCE IN DISPLAY DEVICE

(75) Inventor: Hyeon-Yong Jang, Ohsan-si (KR)

(73) Assignee: Samsung Electronics Co., Ltd. (KR)

( * ) Notice: Subject to any disclaimer, the term of this patent is extended or adjusted under 35 U.S.C. 154(b) by 899 days.

This patent is subject to a terminal disclaimer.

(21) Appl. No.: 12/040,218

(22) Filed: Feb. 29, 2008

(65) Prior Publication Data

US 2008/0211834 A1 Sep. 4, 2008

Related U.S. Application Data

(63) Continuation of application No. 10/799,823, filed on Mar. 12, 2004, now Pat. No. 7,362,303.

(30) Foreign Application Priority Data

Mar. 14, 2003 (KR) ..... 10-2003-0016041

(51) Int. Cl.
*G09G 5/00* (2006.01)

(52) U.S. Cl. ..... 345/213; 345/102

(58) Field of Classification Search ..... 345/84, 345/87, 102, 104, 213

See application file for complete search history.

(56) References Cited

U.S. PATENT DOCUMENTS 4,365,204 A 12/1982 Haque
5,331,253 A 7/1994 Counts
5,844,540 A 12/1998 Terasaki
5,854,543 A 12/1998 Satoh et al.
5,912,713 A 6/1999 Tsunoda et al.
6,011,534 A 1/2000 Tanaka et al.
6,127,865 A 10/2000 Jefferson
6,246,183 B1 6/2001 Buonavita
6,483,253 B1 11/2002 Okamoto et al.
6,944,252 B2 9/2005 Okamoto
6,961,044 B2 11/2005 Woo (Continued)

FOREIGN PATENT DOCUMENTS

EP 1119223 7/2001

(Continued)

OTHER PUBLICATIONS

Daniel Abramovitch; "Phase-Locked Loops: A Control Centric Tutorial"; Proceedings of the American Control Conference, vol. 1, 2002, pp. 1-12.

(Continued)

*Primary Examiner* — My-Chau T Tran
(74) *Attorney, Agent, or Firm* — Cantor Colburn LLP

(57) ABSTRACT

A device for driving a light source in an image display device includes input terminals to receive a horizontal synchronization signal and a control signal, an oscillator to generate a reference signal having a frequency, a controller to modulate the reference signal in response to the control signal and output a modulated signal, and a phase difference detecting unit to receive the horizontal synchronization signal and the modulated signal and detect a phase difference between the horizontal synchronization signal and the modulated signal to generate an output signal indicating the phase difference. The oscillator adjusts the frequency of the reference signal in response to the output signal of the phase difference detecting unit so that the horizontal synchronization signal and the reference signal are synchronized with each other.

19 Claims, 5 Drawing Sheets

U.S. PATENT DOCUMENTS

| | | | | |
|---|---|---|---|---|
| 7,138,974 | B2 | 11/2006 | Hirakata et al. | |
| 7,145,546 | B2 | 12/2006 | Kang et al. | |
| 7,362,303 | B2 * | 4/2008 | Jang | 345/102 |
| 2002/0050973 | A1 | 5/2002 | Takaoka et al. | |
| 2004/0004596 | A1 | 1/2004 | Kang et al. | |

FOREIGN PATENT DOCUMENTS

| | | |
|---|---|---|
| GB | 2378062 | 1/2003 |
| JP | 09237684 | 9/1997 |
| JP | 10247593 | 9/1998 |
| JP | 2000-323292 | 11/2000 |
| JP | 2002-132228 | 5/2002 |
| KR | 100292551 | 3/2001 |

OTHER PUBLICATIONS

European Search Report for application No. 04005862.0-2205 dated Mar. 21, 2006.

* cited by examiner

DEVICE AND METHOD OF DRIVING LIGHT SOURCE IN DISPLAY DEVICE

CROSS REFERENCE TO RELATED APPLICATIONS

This application is a continuation application of U.S. application Ser. No. 10/799,823 filed Mar. 12, 2004, which claims priority to and the benefit of Korean Patent Application No. 2003-0016041 filed on Mar. 14, 2003 2002-0042659, all of which are incorporated by reference herein in their entirety.

BACKGROUND OF THE INVENTION

1. Field of the Invention

The present invention relates to devices for displaying images, and more particularly, to a device and a method of driving a light source for image display devices.

2. Description of the Related Art

Display devices, such as computer monitors, television sets, etc., generally include self-emitting display devices employing light emitting diodes (LEDs), electroluminescences (ELs), vacuum fluorescent display (VFD), field emission display (FED) and plasma panel display (PDP), and non-emitting display devices employing liquid crystal display (LCD) which necessitates a light source.

LCD devices are generally equipped with two panels each having a field-generating electrode and a liquid crystal (LC) layer with dielectric anisotropy. The LC layer is interposed between the two panels. The field-generating electrodes are each supplied with an electric voltage to generate electric fields across the liquid crystal layer. The light transmittance of the LC layer varies in association with the strength of the electric fields, which is controlled by the applied voltage. Accordingly, desired images are displayed by adjusting the applied voltage.

The light for an LCD device is provided by a light source equipped within the LCD device or may be the natural light. In case of employing a light source to provide the light, the brightness on a screen of the LCD device is usually adjusted by regulating the ratio of on- and off-time of the light source or regulating the current flowing the light source.

As a light source for the LCD devices, fluorescent lamps are usually used. The fluorescent lamps generally require a high AC voltage of which magnitude is typically in the range of several kilovolts and frequency in the range of dozens of kilohertz. The current flowing such fluorescent lamps has a magnitude of several milli-amperes. Since the lamps are disposed at the rear side of an LCD panel and close to the panel at a distance of several millimeters, electric fields and magnetic fields from the lamps make noise to signals in wires and thin film transistors (TFTs) of the LCD panel. In particular, since the frequency of a driving signal for the lamps and the frequency of a horizontal synchronization signal for the LCD panel are similar to each other but a slight difference, a beating occurs to cause interference which makes horizontal stripes, called waterfall, on the LCD screen.

In order to coinciding the frequency of the lamp driving signal and the frequency of the horizontal synchronization signal for removing such problems, a triangular pulse width modulation (PWM) reference signal having a frequency lower than the frequency of the horizontal synchronization signal is generated and the reference signal is dropped to a bottom level at the time of synchronization by using short pulses to be initiated.

However, in the display devices employing the conventional light source driving devices and method, the triangular reference wave is generated to have rising portions and falling portions, which are asymmetric to each other. As a result, are caused several problems such as reduced lifetime and unstable ignition of the lamps.

SUMMARY OF THE INVENTION

The above mentioned and other drawbacks and deficiencies of the prior art are overcome or alleviated by a display device according to the present invention. In one embodiment, a device for driving a light source of an image display device comprises input terminals to receive a horizontal synchronization signal and a control signal externally provided, an oscillator to generate a reference signal having a frequency, a controller to modulate the reference signal in response to the control signal and output a modulated signal, and a phase difference detecting unit to receive the horizontal synchronization signal and the modulated signal and detect a phase difference between the horizontal synchronization signal and the modulated signal to generate an output signal indicating the phase difference, wherein the oscillator adjusts the frequency of the reference signal in response to the output signal of the phase difference detecting unit so that the horizontal synchronization signal and the reference signal are synchronized with each other. The control signal externally provided includes a signal to control luminance on a screen of the image display device.

The phase difference detecting unit may include a phase comparator to compare phases of the horizontal synchronization signal and the modulated signal and generate an output signal of which value is determined based on the comparison, and an integrator to generate a voltage signal having a magnitude proportional to an integration of the output signal of the phase comparator. The integrator may include a voltage divider having resistors connected between a supply voltage and ground, an operational amplifier having an inverting terminal to receive the output signal of the phase comparator and a non-inverting terminal connected to the voltage divider, a capacitor connected between the inverting terminal and an output terminal of the operational amplifier, and a reset unit to initiate the integrator in response to an externally provided instruction signal by discharging the capacitor in the integrator.

In another embodiment, the light source drive device may also include a frequency divider to divide a frequency of the modulated signal provided from the controller to generate a frequency-divided signal. The light source drive device may further include a low pass filter connected between the phase comparator and the integrator, in which the low pass filter filters out high frequency components of the output signal of the phase comparator.

In another embodiment, the light source drive device may also include a switch circuit to receive the modulated signal from the controller and generate a switch signal having on and off levels by switching a supply voltage in accordance with the modulated signal, and a transformer to receive the switch signal from the switch circuit and generate a sinusoidal signal which is applied to the light source.

In another embodiment, there is provided a method of driving a light source in an image display device, comprising the steps of generating a reference signal having a frequency, detecting a phase difference between a horizontal synchronization signal for the image display device and the reference signal to generate a detect signal, adjusting the frequency of the reference signal in response to the detect signal, and providing a driving signal to the light source in response to the adjusted reference signal.

The detecting step may include comparing the horizontal synchronization signal and the reference signal, integrating a result signal obtained from the comparing step to generate an integrated voltage signal as the detect signal, and resetting the integrating step such that the integrated voltage signal returns to an initial status. The method may further include performing pulse width modulation with respect to the reference signal to generate a modulated signal, and dividing a frequency of the modulated signal to generate a frequency-divided signal, in which the detect signal is obtained by detecting the phase difference between the horizontal synchronization signal and the frequency-divided signal.

These and other objects, features and advantages of the present invention will become apparent from the following detailed description of illustrative embodiments thereof, which is to be read in connection with the accompanying drawings.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF THE INVENTION

Figure 1:
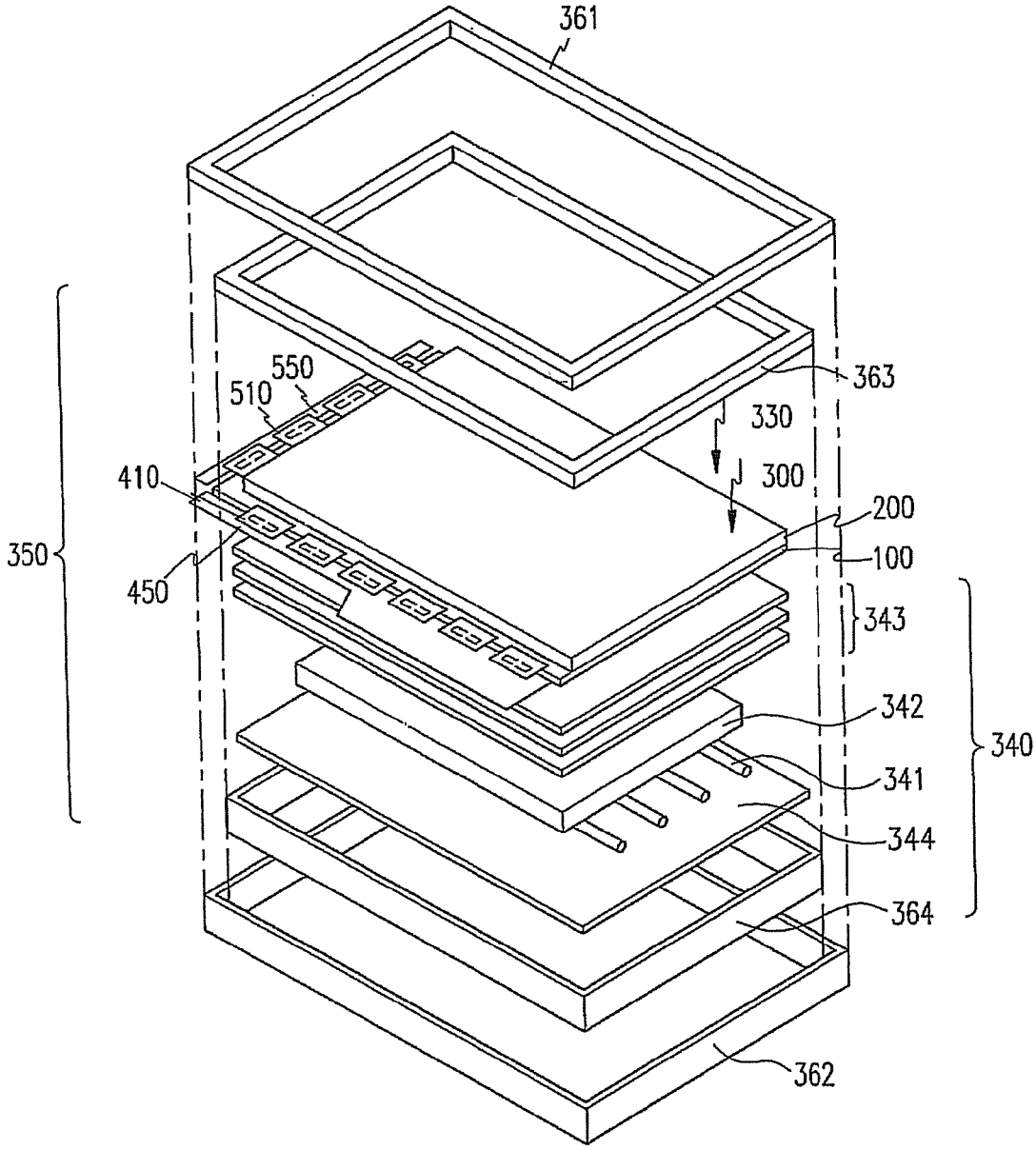
FIG. 1 is an exploded perspective view of an image display device according to an embodiment of the present invention.

Detailed illustrative embodiments of the present invention are disclosed herein. However, specific structural and functional details disclosed herein are merely representative for purposes of describing exemplary embodiments of the present invention.

In the drawings, the thickness of layers and regions are exaggerated for clarity, and the like numerals refer to like elements.

Figure 2:
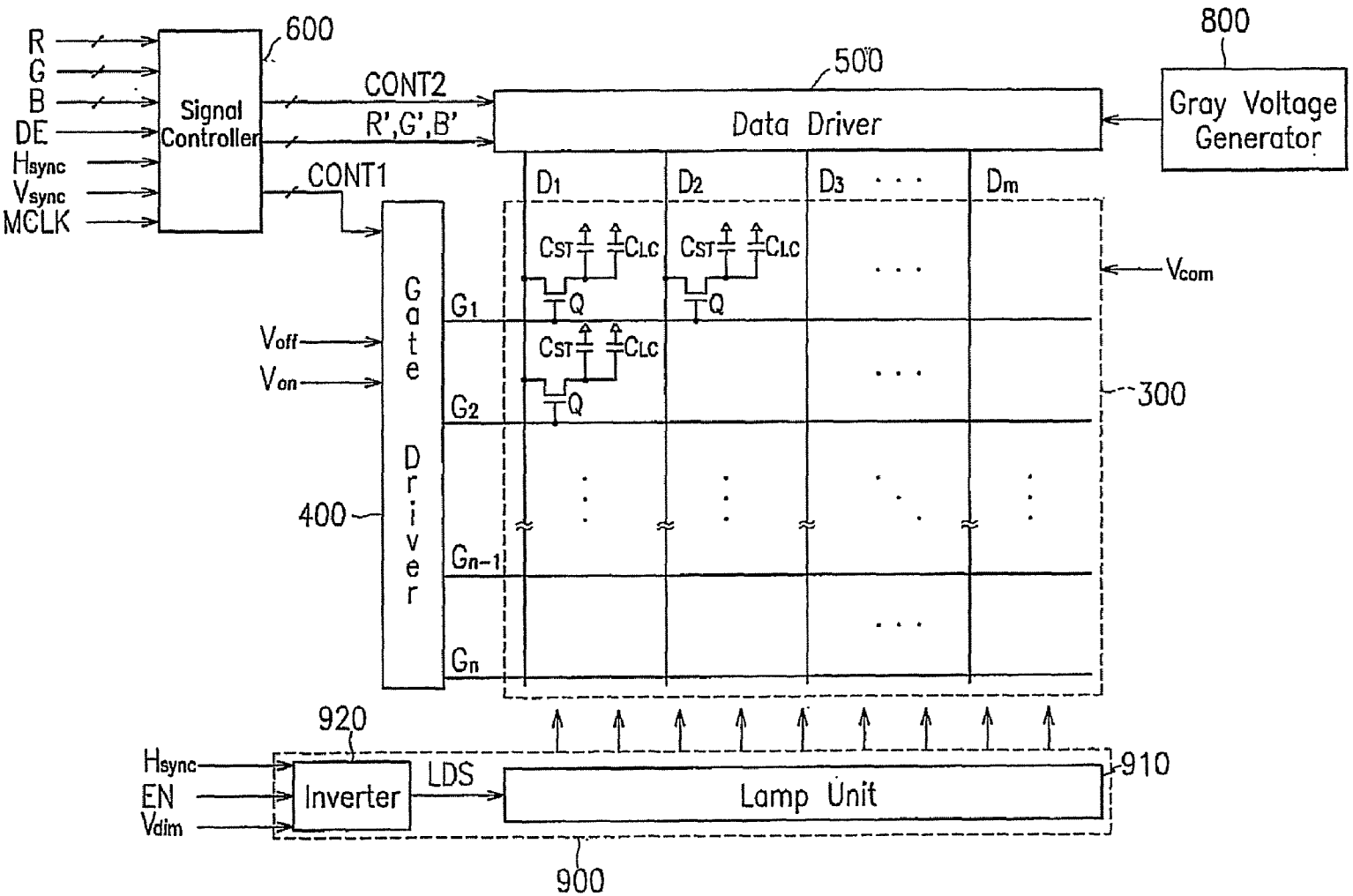
FIG. 2 is a block diagram illustrating a part of the image display device of the present invention.
Figure 3:
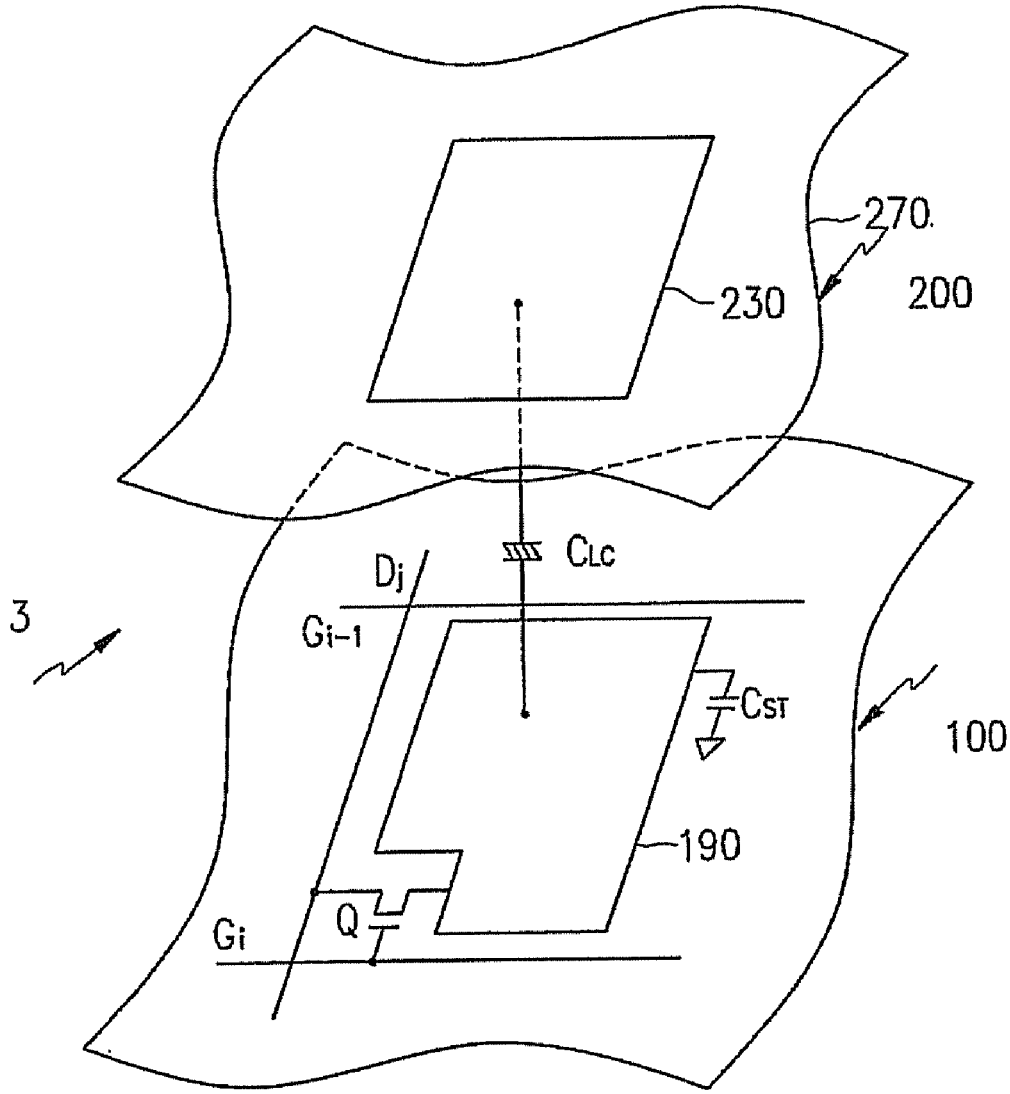
FIG. 3 is an equivalent circuit diagram of a pixel of the image display device according to an embodiment of the present invention.

FIG. 1 is an exploded perspective view of an image display device according to an embodiment of the present invention, FIG. 2 is a block diagram illustrating a part of the image display device of the present invention, and FIG. 3 is an equivalent circuit diagram of a pixel of the image display device according to an embodiment of the present invention.

Referring to FIG. 1, the image display device, such as a liquid crystal display (LCD) device, of the present invention includes a display module 350 including a display unit 330, a backlight unit 340, a pair of front and rear cases 361 and 362, a chassis 363, and a mold frame 364 containing and fixing the display module 350.

The display unit 330 includes a display panel assembly 300, gate tape carrier packages (TCPs) or chip-on-film (COF) type packages 510 mounting gate driving ICs and data TCPs 410 attached to the display panel assembly 300, and a gate printed circuit board (PCB) 550 and a data PCB 450 attached to the gate and data TCPs 510 and 410, respectively.

The backlight unit 340 includes lamps 341 disposed behind the display panel assembly 300, a spread plate 342 and optical sheets 343 disposed between the panel assembly 300 and the lamps 341. The spread plate 342 guides and diffuses light from the lamps 341 to the panel assembly 300. The backlight unit also includes a reflector 344 disposed under the lamps 341 and reflecting the light from the lamps 341 toward the panel assembly 300.

The lamps 341 are, for example, fluorescent lamps such as CCFL (cold cathode fluorescent lamp) and EEFL (external electrode fluorescent lamp) or LED lamps.

Referring to FIG. 2, the display device of the present invention also includes a gate driver 400 and a data driver 500 which are connected to the display panel assembly 300, a gray voltage generator 800 connected to the data driver 500, a lighting unit 900 for illuminating the panel assembly 300, and a signal controller 600 controlling the above elements.

The display panel assembly 300 includes a lower panel 100, an upper panel 200 and a liquid crystal (LC) layer 3 interposed therebetween (referring to FIG. 3). The display panel assembly 300 includes display signal lines $G_1$-$G_n$ and $D_1$-$D_m$ and pixels which are connected to the display signal lines $G_1$-$G_n$ and $D_1$-$D_m$ and arranged in a matrix form.

The display signal lines $G_1$-$G_n$ and $D_1$-$D_m$ are disposed on the lower panel 100 and include gate lines $G_1$-$G_n$ transmitting gate signals (called scanning signals) and data lines $D_1$-$D_m$ transmitting data signals. The gate lines $G_1$-$G_n$ are arranged in a row direction and substantially parallel to each other, and the data lines $D_1$-$D_m$ are arranged in a column direction and substantially parallel to each other.

Each pixel of the display device includes a switching element Q connected to the display signal lines $G_1$-$G_n$ and $D_1$-$D_m$, and capacitors $C_{LC}$ and $C_{ST}$ that are connected to the switching element Q. Capacitor $C_{LC}$ is, for example, a liquid crystal (LC) capacitor formed between the lower and upper panels 100 and 200. The storage capacitor $C_{ST}$ may be omitted.

The switching element Q is implemented with, for example, a thin film transistor and disposed on the lower panel 100. The switching element Q has three terminals: a control terminal connected to one of the gate lines $G_1$-$G_n$, an input terminal connected to one of the data lines $D_1$-$D_m$, and an output terminal connected to the LC capacitor $C_{LC}$ and the storage capacitor $C_{ST}$.

The LC capacitor $C_{LC}$ includes a pixel electrode 190 on the lower panel 100, a common electrode 270 on the upper panel 200, and the LC layer 3 as a dielectric between the electrodes 190 and 270. The pixel electrode 190 is connected to the switching element Q, and the common electrode 270 covers the entire surface of the upper panel 100 and is supplied with a common voltage Vcom. Alternatively, both the pixel electrode 190 and the common electrode 270, which have shapes of bars or stripes, are disposed on the lower panel 100.

The storage capacitor $C_{ST}$ is an auxiliary capacitor for the LC capacitor $C_{LC}$. The storage capacitor $C_{ST}$ includes the pixel electrode 190 and a separate signal line (not shown) disposed on the lower panel 100. An insulator (not shown) is disposed between the separate signal line and the pixel electrode 190, and the separate signal line is supplied with a predetermined voltage such as the common voltage Vcom. It is noted that the storage capacitor $C_{ST}$ may include in another embodiment the pixel electrode 190 and an adjacent gate line (or a previous gate line), in which an insulator is disposed between the adjacent gate line and the pixel electrode 190.

For color display, each pixel uniquely represents one of three primary colors (i.e., spatial division) or each pixel represents three primary colors in turn (i.e., time division) such that spatial or temporal sum of the three primary colors are recognized as a desired color. FIG. 3 shows an example of the spatial division that each pixel is provided with a color filter 230, one of red, green and blue color filters, in an area of the upper panel 200 facing the pixel electrode 190. Alternatively, the color filter 230 is provided on or under the pixel electrode 190 on the lower panel 100.

Referring again to FIG. 2, the lighting unit 900 includes a lamp unit 910 having the lamps 341 shown in FIG. 1 and an inverter 920 connected to the lamp unit 910. The inverter 920 turns on and off the lamp unit 910 and controls the timing of on-time and off-time of the lamp unit to adjust luminance of a display screen. The inverter 920 may be mounted on a stand-alone inverter PCB (not shown) or mounted on the gate PCB 550 or the data PCB 450. A detailed configuration of the inverter 920 will be described.

A pair of polarizers (not shown) polarizing the light from the lamps 341 are attached on the outer surfaces of the panels 100 and 200 of the panel assembly 300.

The gray voltage generator 800 is disposed on the data PCB 450. The gray voltage generator 800 generates two sets of gray voltages related to the transmittance of the pixels. The gray voltages in one set have a positive polarity with respect to the common voltage Vcom, and those in the other set have a negative polarity with respect to the common voltage Vcom.

The gate driver 400 includes integrated circuit (IC) chips mounted on the respective gate TCPs 510. The gate driver 400 is connected to the gate lines $G_1$-$G_n$ of the panel assembly 300 and synthesizes the gate-on voltage Von and the gate-off voltage Voff from an external device to generate gate signals for application to the gate lines $G_1$-$G_n$. The data driver 500 includes IC chips mounted on the respective data TCPs 410. The data driver 500 is connected to the data lines $D_1$-$D_m$ of the panel assembly 300 and applies data voltages selected from the gray voltages supplied from the gray voltage generator 800 to the data lines $D_1$-$D_m$.

For example, in another embodiment the IC chips of the gate driver 400 and/or the data driver 500 are mounted on the lower panel 100. In further another embodiment, one or both of the drivers 400 and 500 are incorporated along with other elements into the lower panel 100. The gate PCB 550 and/or the gate TCPs 510 may be omitted in such embodiments.

The signal controller 600 controlling the drivers 400 and 500, etc. is disposed on the data PCB 450 or the gate PCB 550.

Now, the overall operation of the image display device will be described in detail. Referring to FIG. 2, the signal controller 600 is supplied with RGB image signals R, G and B and input control signals controlling the display thereof such as a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the image signals R, G and B suitable for the operation of the panel assembly 300 on the basis of the input control signals and the input image signals R, G and B, the signal controller 600 provides the gate control signals CONT1 for the gate driver 400, and the processed image signals R', G' and B' and the data control signals CONT2 for the data driver 500.

The gate control signals CONT1 include a vertical synchronization start signal STV for informing of start of a frame, a gate clock signal CPV for controlling the output time of the gate-on voltage Von, and an output enable signal OE for defining the duration of the gate-on voltage Von. The data control signals CONT2 include a horizontal synchronization start signal STH for informing of start of a horizontal period, a load signal LOAD or TP for instructing to apply the appropriate data voltages to the data lines $D_1$-$D_m$, an inversion control signal RVS for reversing the polarity of the data voltages (with respect to the common voltage Vcom), and a data clock signal HCLK.

The data driver 500 receives a packet of the image data R', G' and B' for a pixel row from the signal controller 600 and converts the image data R', G' and B' into the analog data voltages selected from the gray voltages supplied from the gray voltage generator 800 in response to the data control signals CONT2 from the signal controller 600.

Responsive to the gate control signals CONT1 from the signals controller 600, the gate driver 400 applies the gate-on voltage Von to selected one(s) of the gate lines $G_1$-$G_n$, thereby turning on the switching elements Q connected thereto.

The data driver 500 applies the data voltages to the corresponding data lines $D_1$-$D_m$ for an on-time of the switching elements Q (which is called "one horizontal period" or "1H" and equals to one period of the horizontal synchronization signal Hsync, the data enable signal DE, and the gate clock signal CPV). Then, the data voltages in turn are supplied to the corresponding pixels via the turned-on switching elements Q.

The difference between the data voltage and the common voltage Vcom applied to a pixel is expressed as a charged voltage of the LC capacitor $C_{LC}$, i.e., a pixel voltage. The liquid crystal molecules have orientations depending on the magnitude of the pixel voltage and the orientations determine the polarization of light passing through the LC capacitor $C_{LC}$. The polarizers convert the light polarization into the light transmittance.

By repeating this procedure, all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (which is called "dot inversion").

The inverter 920 drives the lamp unit 910 based on a luminance control signal Vdim, the horizontal synchronization signal Hsync, and an instruction signal EN for turning on and off the lamp unit 910.

Figure 4:
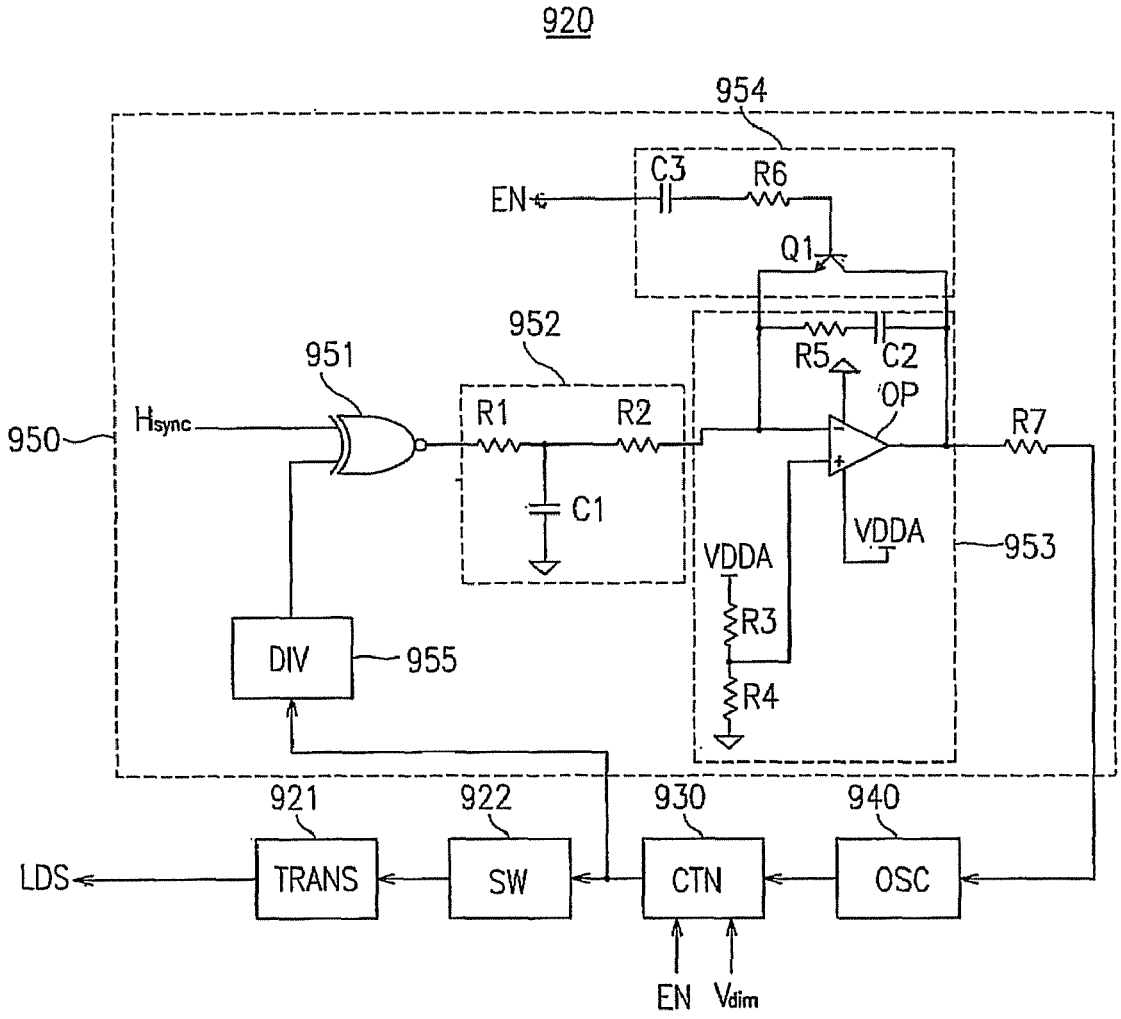
FIG. 4 is a circuit diagram of the inverter in FIG. 2 according to an embodiment of the present invention.

Referring to FIG. 4, the inverter 920 according to an embodiment of the present invention includes a transformer (TRANS) 921, a switch circuit (SW) 922, a controller (CTN) 930, an oscillator (OSC) 940, and a phase difference detecting circuit 950, which are connected in series from the lamp unit 910.

The phase difference detecting circuit 950 includes a phase comparator 951, a low pass filter (LPF) 952, a proportional integrator 953, a reset unit 954, and a frequency divider 955. The phase comparator 951 receives the horizontal synchronization signal Hsync and an output from the frequency divider 955 and outputs logic '0' when the inputs have different logic values and outputs logic '1' the inputs have a same logic value. In this embodiment, the phase comparator 951 is implemented with an XNOR gate. The XNOR gate can be substituted with an XOR gate.

The low pass filter 952 includes two resistors RI and a capacitor C1 connected in series between the phase comparator 951 and the ground, and passes low frequency components of an input signal by filtering out high frequency components of the input signal.

The proportional integrator 953 includes an operational amplifier OP having a negative feedback through an integration capacitor C2 and a resistor R5 connected in series and receiving an output of the low pass filter 952 at its inverting terminal (−). The operational amplifier OP has a non-inverting terminal (+) connected to a voltage divider including a pair of resistors R3 and R4 connected in series between a supply voltage VDDA and the ground. The operational amplifier OP is biased with the supply voltage VDDA and the ground. The proportional integrator 953 outputs a voltage having a magnitude proportional to a temporal integration of the output of the low pass filter 952.

The reset unit 954 includes a switching element Q1 connected with the proportional integrator 953 and a differentiation circuit including a resistor R6 and a capacitor C3 connected in series between a control terminal of the switching element Q1 and an input terminal receiving the instruction signal EN. The reset unit 954 initiates the proportional integrator 953 by discharging the charges stored in the integration capacitor C2. Although the switching element Q1 is implemented with an NPN bipolar transistor in this embodiment, a PNP bipolar transistor or a MOS transistor is also used as the switching element Q1. It is apparent to those skill in the art that some design modifications such as inversion of the value of the instruction signal EN are required when using the PNP transistor or a P-channel MOS transistor.

The frequency divider 955 divides the frequency of the output signal of the controller 930 and outputs the frequency-divided signal to the phase comparator 951. For example, the frequency divider 955 employs a T-flipflop that makes the frequency of a signal inputted into a clock terminal become half. The frequency divider may be omitted when the frequency is maintained same.

Figure 5:
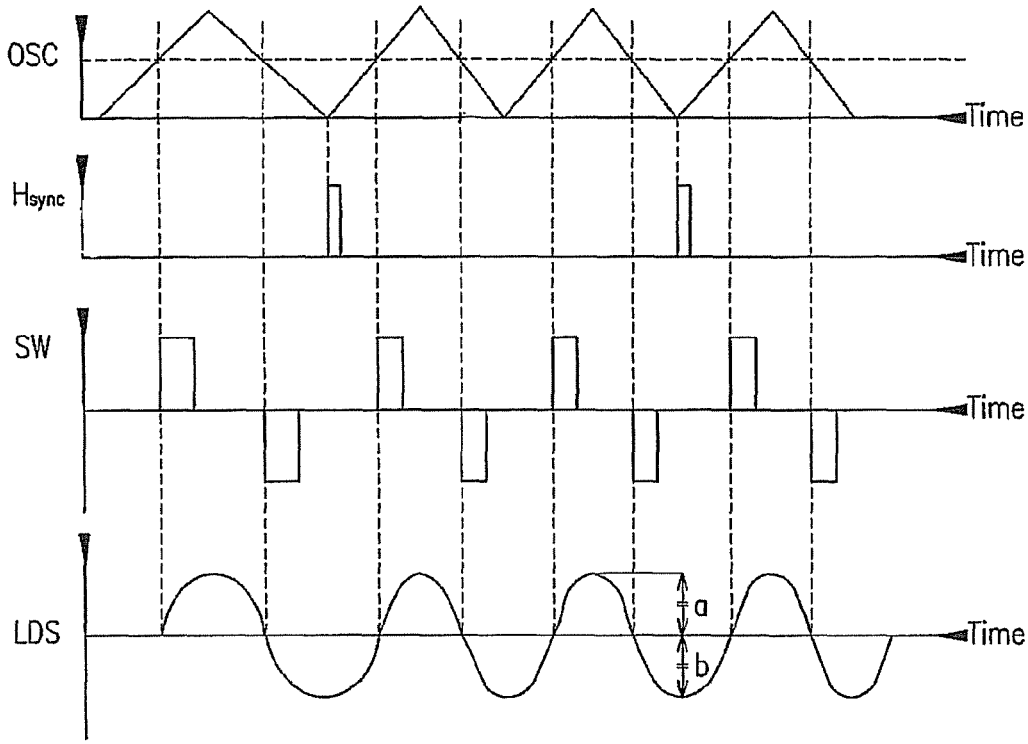
FIG. 5 shows waveforms of output voltages of the parts in FIG. 4 and a lamp current provided to the lamp unit.

Now, the operation of the inverter is described in detail with reference to FIGS. 4 and 5. FIG. 5 shows waveforms of output voltages of the parts in FIG. 4 and a lamp current provided to the lamp unit.

When the dimming control signal Vdim and the instruction signal EN are received, the oscillator 940 generates a reference signal OSC having a triangular waveform or a saw-toothed waveform for pulse width modulation (PWM). The controller 930 pulse-width-modulates the reference signal OSC by using a predetermined reference voltage and supplies a PWM signal to the switch circuit 922. An exemplary frequency of the reference signal OSC is twice the frequency of the horizontal synchronization signal Hsync.

The switch circuit 922 generates a signal SW having on and off levels by switching the DC supply voltage according to the PWM signal as shown in FIG. 5. The transformer 921 generates a sinusoidal signal based on the on/off signal SW and transforms the sinusoidal signal to have a high voltage. The sinusoidal signal generated from the transformer 921 is provided to the lamp unit 910 as the lamp current LDS which turns on the lamps of the lamp unit 910. As shown in FIG. 5, the sinusoidal signal output from the transformer 921 has amplitudes 'a' and 'b' in positive and negative polarities, respectively, which have a substantially same value.

The differentiator C3 and R6 of the reset unit 954 flows a temporary current upon the input of the instruction signal EN to turn on the switching element Q1 for a few microseconds. Then, the charge stored in the integration capacitor C2 of the proportional integrator 953 is discharged and the proportional integrator 953 is initiated.

The PWM signal of the controller 930 is input to the frequency divider 955, where the frequency of the PWM signal is divided. The frequency-divided signal is then input to the phase comparator 951.

The phase comparator 951 outputs logic '1' when the value of the horizontal synchronization signal Hsync is equal to the output signal of the frequency divider 955. The phase comparator 951 also outputs logic '0' when the input signals have different values. Therefore, the output of the phase comparator 951 has a longer duration of logic '1' as the phases of the two input signals coincide, and, on the contrary, it has a longer duration of logic '0' as the phases of the two signals are in discord. As a result, the output of the phase comparator 951 indicates the identity and/or the difference between the phases of the two input signals as function of time.

The output signal of the phase comparator 951 passes through the low pass filter 952 where the high frequency components of the signal are removed, and is converted into an analog voltage, which is charged into the integration capacitor C2 of the proportional integrator 953. Since the output voltage of the proportional integrator 953 is proportional to a temporal integration of the output of the phase comparator 951, it indicates the degree of the phase difference between the two input signals of the phase comparator 951. Since appropriate resistance ratio of the voltage divider R3 and R4 enables to integrate the difference from a desired value, the output voltage of the proportional integrator 953 indicates the difference between the phase difference of the two input signals and the desired value.

The oscillator 940 changes an oscillating frequency of the reference signal OSC based on the output voltage of the proportional integrator 953. That is, the oscillator 940 increases a low frequency of the reference signal OSC, while it reduces a high frequency of the reference signal OSC. The controller 930 pulse-width-modulates and outputs the PWM signal having the changed frequency, and the output signal of the controller 930 is double frequency-divided and is returned to the phase comparator 951.

The horizontal synchronization signal Hsync and the output signal of the frequency divider 955 becomes synchronized by performing the above operation through the feedback loop. In other words, the phases of the horizontal synchronization signal Hsync and the output signal of the frequency divider 955 become coincident. As a result, the frequency of the reference signal OSC of the oscillator 940 becomes twice the frequency of the horizontal synchronization signal Hsync in case of employing the divider 955.

Referring to FIG. 5, the reference signal OSC of the oscillator 940 has a frequency twice that of the horizontal synchronization signal Hsync, and thus the lamp current LDS to be provided to the lamp unit 910 has a symmetrical waveform. Accordingly, the lifetime reduction or unstable ignition of the lamp unit 910 due to asymmetrical current therein can be prevented.

Meanwhile, the luminance of an LCD screen can be controlled by adjusting the ratio of the on-time and the off-time of the lamp unit 910 based on the dimming control signal Vdim, which is inputted from a separate input device adjustable by a user or from the signal controller 600. The controller 930 turns on or off the lamp unit 910 in response to the instruction signal EN. The controller 930 receives a voltage having a magnitude in proportion to the current in the lamp unit 910 and performs feedback control for the lamp unit 910.

According to the present invention, the life time of the lamps is elongated and stable ignition of the lamps is obtained since the positive portions and the negative portions of current waves in the lamps are substantially equal.

Having described the exemplary embodiments of the image display device according to the present invention, modifications and variations can be readily made by those skilled in the art in light of the above teachings. It is therefore to be understood that, within the scope of the appended claims, the present invention can be practiced in a manner other than as specifically described herein.

What claimed is:

1. A device for driving a light source in an image display device, comprising:

input terminals to receive a horizontal synchronization signal and a control signal externally provided;

an oscillator to generate a reference signal having a frequency;

a controller to modulate the reference signal in response to the control signal and output a modulated signal;

a voltage supplying unit to apply AC voltage synchronized with the modulated signal to the light source so as to drive the light source; and a phase difference detecting unit to receive the horizontal synchronization signal and the modulated signal and detect a phase difference between the horizontal synchronization signal and the modulated signal to generate an output signal indicating the phase difference, wherein the oscillator adjusts the frequency of the reference signal in response to the output signal of the phase difference detecting unit so that the horizontal synchronization signal and the reference signal are synchronized with each other, wherein a drive signal of the light source amplitudes in positive and negative polarities, respectively, which have a substantially same value.

2. The device of claim 1, wherein the reference signal has a frequency twice the frequency of the horizontal synchronization signal.

3. The device of claim 1, wherein the reference signal has a triangular waveform or a saw-toothed waveform for pulse width modulation.

4. The device of claim 2, wherein further comprising a switch circuit to receive the modulated signal from the controller and generate a switch signal.

5. The device of claim 4, wherein the switch signal has on and off levels by switching a supply voltage in accordance with the modulated signal.

6. The device of claim 5, wherein further comprising a transformer to receive the switch signal from the switch circuit and generate the drive signal which is applied to the light source.

7. The device of claim 1, wherein the control signal externally provided comprises a signal to control luminance on a screen of the image display device.

8. The device of claim 1, wherein the phase difference detecting unit comprises:

a phase comparator to compare phases of the horizontal synchronization signal and the modulated signal and generate an output signal of which value is determined based on the comparison; and an integrator to generate a voltage signal having a magnitude proportional to an integration of the output signal of the phase comparator.

9. The device of claim 8, wherein the phase comparator comprises an XNOR logic gate or XOR logic gate.

10. The device of claim 9, wherein the integrator comprises:

a voltage divider having resistors connected between a supply voltage and ground;

an operational amplifier having an inverting terminal to receive the output signal of the phase comparator and a non-inverting terminal connected to the voltage divider; and a capacitor connected between the inverting terminal and an output terminal of the operational amplifier.

11. The device of claim 10, wherein the phase difference detecting unit further comprises a reset unit to initiate the integrator in response to an externally provided instruction signal by discharging the capacitor in the integrator.

12. The device of claim 11, wherein the reset unit comprises a switch element connected with the integrator parallel with the capacitor with respect to the operational amplifier, the switch element being controlled by the instruction signal.

13. The device of claim 1, further comprising a frequency divider to divide a frequency of the modulated signal provided from the controller to generate a frequency-divided signal.

14. A method of driving a light source in an image display device, comprising:

generating a reference signal having a frequency;

detecting a phase difference between a horizontal synchronization signal for the image display device and the reference signal to generate a detect signal;

adjusting the frequency of the reference signal in response to the detect signal; and providing a driving signal to the light source in response to the adjusted reference signal, wherein a drive signal of the light source amplitudes in positive and negative polarities, respectively, which have a substantially same value.

15. The method of claim 14, wherein the detecting step comprises:

comparing the horizontal synchronization signal and the reference signal; and integrating a result signal obtained from the comparing step to generate an integrated voltage signal as the detect signal.

16. The device of claim 14, wherein the reference signal has a frequency twice the frequency of the horizontal synchronization signal.

17. The method of claim 16, further including resetting the integrating step such that the integrated voltage signal returns to an initial status.

18. The method of claim 17, further comprising:

performing pulse width modulation with respect to the reference signal to generate a modulated signal; and dividing a frequency of the modulated signal to generate a frequency-divided signal, wherein the detect signal is obtained by detecting the phase difference between the horizontal synchronization signal and the frequency-divided signal.

19. The method of claim 17, further comprising filtering out high frequency components of the result signal obtained from the comparing step.

* * * * *